US006590480B2

(12) United States Patent
Matsuda

(10) Patent No.: US 6,590,480 B2
(45) Date of Patent: Jul. 8, 2003

(54) ELECTROMAGNETIC RELAY

(75) Inventor: Kazuhisa Matsuda, Kyoto (JP)

(73) Assignee: Omron Corporation, Kyoto (JP)

( * ) Notice: Subject to any disclaimer, the term of this patent is extended or adjusted under 35 U.S.C. 154(b) by 0 days.

(21) Appl. No.: 09/960,311

(22) Filed: Sep. 24, 2001

(65) Prior Publication Data

US 2002/0036556 A1 Mar. 28, 2002

(30) Foreign Application Priority Data

Sep. 26, 2000 (JP) ..... 2000-291890

(51) Int. Cl.[7] ..... H01H 51/22

(52) U.S. Cl. ..... 335/78; 335/80; 335/83; 335/202

(58) Field of Search ..... 336/198, 192; 335/128, 124, 78

(56) References Cited

U.S. PATENT DOCUMENTS 3,618,136 A * 11/1971 Fujita ..... 335/82
5,038,122 A * 8/1991 Nakayama et al. ..... 335/78
6,069,547 A * 5/2000 Sakamoto ..... 335/289
6,337,614 B1 * 1/2002 Tsutsui ..... 335/160
6,414,576 B1 * 7/2002 Nakamura et al. ..... 335/83

FOREIGN PATENT DOCUMENTS

| | | |
|---|---|---|
| JP | 56-93234 | 7/1981 |
| JP | 3-12198 | 3/1991 |
| JP | 10-162712 | 6/1998 |
| JP | 2000-315448 A | 11/2000 |

* cited by examiner

*Primary Examiner*—Elvin Enad
*Assistant Examiner*—Bernard Rojas
(74) *Attorney, Agent, or Firm*—Foley & Lardner

(57) ABSTRACT

A low strength part (groove) 62, which is low in rigidity and on which stress concentrates, is formed along a portion demarcating the end edge part 61 of a flange 32*b* located at the inner part of a case, which faces the top end part (plate-like part 41*a*) of a fixed terminal 41. The fixed terminal 41 is secured to a flange 32*a* which is located at the opened side of the case.

10 Claims, 9 Drawing Sheets

ELECTROMAGNETIC RELAY

CROSS-REFERENCE TO RELATED PATENT APPLICATIONS

Japan Priority Application 2000-291890, filed Sep. 26, 2000 including the specification, drawings, claims and abstract, is incorporated herein by reference in its entirety.

BACKGROUND OF THE INVENTION

1. Field of the Invention

The present invention relates to an electromagnetic relay comprising a case with an opening at one end thereof, which covers the whole relay, a spool with a coil as an electromagnet wound therearound, a fixed contact, and a movable contact, wherein a first flange of the spool is located on the opening of the case, a second flange of the spool is located on an inner side of the case, the fixed contact and the movable contact are oppositely disposed at positions closer to the inner part than the second flange of the spool, and a fixed terminal with the fixed contact provided thereon is mounted on the spool.

2. Description of the Related Art

Generally, an electromagnetic relay is constructed such that a movable contact and a fixed contact are located on an opposite side (case inner side) of a terminal side from which connection terminal ends of terminals are derived. The movable contact is moved in an axial direction of the coil to cause a switchover of a conduction state (contact state) to the fixed contact. In such an electromagnetic relay, as described also in Japanese Patent Unexamined Publication No. Sho. 56-93234, it is a common practice that the fixed terminal with the fixed contact secured at one end thereof is secured, by press-fitting or the like, to a thick part of the case-inner-side flange of the resin spool on which a coil is to be wound. Another type of electromagnetic relay is also known. In the electromagnetic relay, the other end (connection terminal end) of the fixed terminal is press fit to a base located outside the terminal-side flange of the spool, whereby the fixed terminal is firmly supported (see FIG. 2 of Japanese Utility Model Unexamined Publication No. Hei. 3-12198).

Size and cost reduction is a strong demand in the small electromagnetic relay (height: 20 mm or less), which is mounted on a printed circuit board used in a motor vehicle. To meet the demand, further reduction of the number of required component parts and further increase of parts assembling density are essential.

An electromagnetic relay presenting a solution to such a problem is disclosed in Japanese Patent Unexamined Publication No. Hei. 10-162712. In the publication, a member called a base, which is conventionally used as the base in assembling the relay parts, is omitted. One of the flanges of the spool, on which a coil for the electromagnet is to be wound, is located inside the opening of the case, and this flange is used for the base.

In this type of small electromagnetic relay, a sealed electromagnetic relay (i.e., sealing type relay) is dominantly used in order to endure the washing process carried out after it is mounted on the printed circuit board, and to secure given water- and dust-proof performance. The washing process is carried out after the soldering for mounting the relay on the printed circuit board. Accordingly, the relay being heated is rapidly cooled by the washing liquid. This gives rise to a pressure difference between the inside and the outside of the relay. In this condition, washing liquid is easily pulled into the relay assembly through gap or gaps even if gap or gaps are small. To avoid this, a high degree of hermeticity is required for the relay assembly.

FIG. 8A shows a diagram of a conventional electromagnetic relay of such a type for the purpose of comparison.

In this relay designated by reference numeral 1, a flange 2*a* located on the case opened side of a spool 2 is used as a base in assembling the electromagnetic relay. The relay 1 is constructed with the spool 2, an iron core (not shown) of the electromagnet mounted while being inserted into the spool 2, an L-shaped yoke 4, a movable iron member 5, an L-shaped movable contact spring (movable contact terminal) 6, a movable contact 7, a first fixed contact (NC contact) 8, a first fixed terminal 9, a second fixed contact (NO contact) 10, a second fixed terminal 11, first and second coil terminals 12 and 13, and a case 14. A coil 1*a* forming an electromagnet is wound around the spool 2. The yoke 4 is coupled to the iron core, and provides a magnetic path allowing lines of magnetic force to pass therethrough. The movable iron member 5 is joined at the base end to the top end (=the upper end in FIGS. 8A and 8B) of the yoke 4, and the top end of the movable iron member 5 may be swung under attraction by the iron core when current is fed to the coil. The movable contact spring 6 consists of a plate spring the top end of which may be swung, and mounted on the movable iron member 5 at the top end thereof. The movable contact 7 is mounted to the top end of the movable contact spring 6. The movable contact 7 is in pressing contact with the first fixed contact 8 when no current is fed to the coil. The first fixed contact 8 is mounted on the upper end of the first fixed terminal 9. The movable contact 7 is in pressing contact with the second fixed contact 10 when current is fed to the coil. The second fixed contact 10 is mounted on the upper end of the second fixed terminal 11. The first and second coil terminals 12 and 13 are connected to lead wires of the coil, respectively. An assembling side (=lower side in FIGS. 8A and 8B) of the case 14 is opened.

The strip-like parts of the movable contact spring 6, first fixed terminal 9 and second fixed terminal 11, which are extended to the opened side (=lower end side in FIGS. 8A and 8B) of the case 14, are protruded to positions outside the flange 2*a* (base) to form connection terminals 21 to 23 used for connecting the individual contacts to given circuit conductors, respectively, like the first and second coil terminals 12 and 13. In FIGS. 8A and 8B, the second coil terminal 13 is located on the opposite side of the first coil terminal 12. The lower end of the first fixed terminal 9 (=connection terminal 22) is also located on the opposite side of the lower end of the second fixed terminal 11 (=connection terminal 23).

In assembling the relay 1, components parts other than the case 14 are assembled, while using the flange 2*a* as the base member, into a sub-assembly. The case 14 is applied to the sub-assembly to cover the latter. Thereafter, the opening side of the case 14 is sealed with a sealing material 20, e.g., thermosetting resin, to complete an electromagnetic relay.

The first fixed terminal 9 and the second fixed terminal 11 are press-fit to the flange 2*a* (case-opened-side flange) of the spool 2 at positions indicated as A in FIG. 8A. Those fixed terminals are also press-fit to a flange 2*b* (case-inner-side flange) of the spool 2 at positions denoted as B in FIG. 8A.

In the relay of the above-mentioned type, there are the following problems.

(1) As described above, the fixed terminals with the fixed contacts secured thereto are secured to the case-inner-side flange, or to both the case-inner-side flange and the case-opening-side flange as shown in FIG. 8A. Therefore, there is a chance that in an abnormal state of overcurrent feeding, the second fixed contact (NO contact) 10 is left in contact with the movable contact 7 (their conduction state is retained).

The reason for this is that in a state where overcurrent is fed to the coil, the coil 1*a* is heated to high temperature, and hence it is thermally expanded in the axial direction of the coil. As a result, the spool 2 is deformed such that the flanges 2*a* and 2*b* are spaced apart from each other as indicated by arrows in FIG. 8A. With the deformation, a part of the second fixed terminal 11 near its position at which the fixed terminal is secured to the flange 2*b* located at the inner side of the case (i.e., part to which the second fixed contact 10 is secured) moves to the inner side of the case.

Usually, the second fixed contact (NO contact) 10 is connected to a power line of a load (e.g., a motor) for the purpose of power supplying. The first fixed contact (NC contact) 8 is connected to a ground line. Accordingly, if the on state of the NO-contact (conduction holding state) is continued, a fire by the heating thereat may be caused. If the conduction holding state further continues and the above deformation further progresses, the movable contact 7, the first fixed contact (NC contact) 8 and the second fixed contact (NO contact) 10 are brought into contact with one another in a superimposing fashion, as shown in FIG. 8B. In this state, there is a danger that a short circuit occurs between the power source and ground.

(2) Since a part of the fixed terminal near the fixed contact thereof is secured to the case-inner-side flange 2*b*, a deformation (warp) of the flange 2*b* in the axial direction of the coil results in a displacement of the fixed contact position (particularly in the coil axial direction). As a result, a pressure of the contact varies, and its characteristic tends to excessively vary. Usually, the coil is densely wound around the spool of the electromagnetic relay and hence, the coil will constantly expand outside. Accordingly, an outside expanding force of the coil (=pressure acting in the coil axial direction) constantly acts on the spool. Because particularly, in the case of the small electromagnetic relay as mentioned above, the flanges of the spool is thin, the flanges of the spool are considerably deformed (warped) by the coil axial direction pressure, as shown in FIG. 9A. As the result of the deformation, the fixed contact also displaces, and its characteristic value will be greatly different from its design value.

Particularly, when thermosetting resin is used for the sealing material, a residual stress within the coil is relatively greatly lessened by the aging after the coil is wound, and the thermosetting process (heating process) of the sealing material after the assembling of the relay (after the sealing material is applied). The inventors of the present patent application discovered the fact: The flanges of the spool, which have expanded outside as shown FIG. 9A, have such a nature that those flanges inwardly displace (mutually approach) to resume their original shape as shown in FIG. 9B.

An effect of a lateral displacement of the contact position of the contact on its characteristic, e.g., contact resistance, is relatively small. In the contact of some size, it will be absorbed to be negligible. On the other hand, a displacement of the fixed contact in a contact direction where the movable contact moves (viz., the coil axial direction) greatly affects the contact pressure, causing a great variation of the characteristic. Particularly, when the thermosetting resin is used for the sealing material, due to the recovery of the spool from its deformation, the case-inner-side flange 2*b* and the second fixed contact 10 are displaced, by a noticeable extent, toward the opened side of the case (to such a direction in which those move apart from the movable contact 7), after the assembling of the relay. Accordingly, the contact pressure, which was adjusted to have an optimum value (at the time of assembling the component parts within the case), varies to diminish, thereafter. As a result, it is impossible to secure a required contact pressure. The number of the resultant products, which fail to satisfy the required product specifications, is increased (viz., the product yielding reduces). This fact was confirmed by the inventors.

SUMMARY OF THE INVENTION

Accordingly, a first object of the present invention is to provide an electromagnetic relay in which flanges of a spool are respectively located at an opened side of the case and an inner part of the case, and a fixed terminal is mounted on the spool, the relay being improved such that even if the coil is thermally expanded, there is no (or little) chance that the NO contact is put in the conduction holding state.

A second object of the present invention is to provide an electromagnetic relay which is free from the decrease of a contact pressure of the NO contact, which results from the recovery of the spool from its deformation in the case of using the thermosetting resin for the sealing material.

According to a first aspect of the invention, there is provided a first electromagnetic relay comprising:

- a case having an opening at one end thereof and covering the whole electromagnetic relay;
- a spool with a coil as an electromagnet wound therearound, the spool including a first flange disposed inside the case and at an opened side of the case, and a second flange disposed at an inner part of the case;
- a fixed contact disposed at a top end part of a fixed terminal extending to a position closer to the inner part of the case than the second flange of the spool; and
- a movable contact disposed at a position closer to the inner part of the case than the fixed contact, the movable contact being brought into contact with or separated from the fixed contact by an attraction force of the electromagnet and a restoring force of a spring for supporting the movable contact, whereby a conduction state between a movable terminal conductively coupled to the movable contact and the fixed terminal is switched over, wherein the second flange has an end edge part facing the top end part of the fixed terminal, and a low strength part, which is low in rigidity and on which stress concentrates, disposed along a portion demarcating the end edge part of the second flange, and the fixed terminal is secured to the first flange.

In the specification, the term "fixed contact" or "fixed terminal" means a "NO contact", which is separated from a movable contact in a normal state (when the coil is fed with no current) or a fixed terminal with the NO contact provided thereon.

The electromagnetic relay constructed according to the present invention may include an NC contact, which is in contact with a movable contact in a normal state (when the coil is fed with no current), as will be described later.

It should be understood that some of the novel and unique features of the invention will effectively be operable even in the structures including a fixed contact and a fixed terminal, which are associated with the NC contact. In the description to be given hereunder, the present invention is applied to a relay structure associated with the NO contact, for simplicity of explanation.

In the first electromagnetic relay constructed according to the invention, if the coil is thermally expanded, a transmission of such a force as to act on a second flange (located at the inner part of the case) of the spool to expand the second flange is blocked or impeded in the low strength part. Meanwhile, the fixed terminal (=fixed terminal for NO contact) is secured to the first flange (located at the opened side of the case) of the spool. Therefore, even if the coil is thermally expanded, the end edge part of the flange located at the inner part of the case, which faces the top end part (fixed contact) of the fixed terminal, and the fixed contact are not displaced to the inner side of the case (toward the movable contact) (or its displacement is considerably reduced or it is displaced to the opened side of the case). For this reason, such an unwanted situation that the coil is thermally expanded, the spool is deformed, and hence the fixed contact (NO contact) is pressed against the movable contact, never happens. Accordingly, even in an abnormal state of overcurrent feeding, there is no chance that that the fixed contact (NO contact) is held while being in contact with the movable contact (viz., the relay has a function of self-interrupting the overcurrent.). In other words, even when the coil is heated to excessive temperature, the fixed contact can be separated from the movable contact to the opened side of the case. Accordingly, a probability that fire accident occurs owing to the conduction retaining is completely eliminated.

In particular, when the low strength part is designed such that it is broken by stress and heat caused by an abnormal expansion of the coil, the transmission of the force acting to pressing the fixed contact against the movable contact (viz., the force for displacing it toward the inner part of the case) is completely blocked. The fixed contact is reliably held at a normal position at which it is supported by the fixed terminal secured to the flange located on the opened side of the case (normal position=position sufficiently spaced apart from the movable contact when no current is fed to the coil). Accordingly, fire accident can be prevented with higher reliability.

The flange of the case opened side is used lubricant also as a base for the assembling of the relay. Accordingly, it is designed to be thick and having a high rigidity when comparing with the flange of the inner part of the case. Accordingly, where the fixed terminal is secured to the flange of the case opened side, the top end part (i.e., the fixed contact) of the fixed terminal is hard to displace toward the movable contact. The fixed contact is reliably held at a position separated from the movable contact while not affected by the deformation of the flange of the case inner part since the low strength part is present.

In the electromagnetic relay, the low strength part may consist of a thinned part. The low strength part may also consist of a plurality of holes (through hole or non-through hole) formed in the second flange. The thinned part is formed by grooving a surface the second flange at the inner side of the case.

The first electromagnetic relay contributes to solve the problem of the deformation of the spool by the pressure having the coil axial direction and the configuration recovery of the deformed spool which subsequently occurs. The reason for this follows. As seen also from FIG. 6A, when the spool is deformed to be expanded by the pressure having the coil axial direction, the end edge part of the flange facing the top end part of the fixed terminal (i.e., the part which is secured to the fixed contact) is greatly bent since the low strength part (groove or the like) is present. With the bending, a force applied to the top end part of the fixed terminal is greatly lessened. As a result, there is no or little chance that the spool is deformed by the coil axial directional pressure, and hence the fixed contact is pressed against the movable contact. Thence, the contact pressure reduction arising from the subsequent configuration recovery of the deformed spool is removed or lessened.

The electromagnetic relay of the embodiment is capable of suppressing the vibration and noise generated when the contact is closed (produces silencing effects). The reason for this is that the vibration caused when the movable contact hits the fixed contact is flexibly absorbed by the edge end part of the flange at the case inner part, which is disposed facing the top end part of the fixed terminal. More specifically, the edge end part is parted from the remaining portion by the low strength part. Accordingly, it is easy to be bent. The vibration is absorbed by its flexible deformation. As a result, the noise caused by the vibration is reduced.

Additionally, it is noted that the low strength part□takes the form of the groove. This groove serves also as a barrier to prevent insulation deterioration by carbon particles generated when the contact is opened and closed.

In a preferred embodiment, the fixed terminal is secured to the first flange in a manner that a protruded part extending from the fixed terminal is press fit into a hole of the flange located at the case opened side of the spool, and a part near the fixed contact of the fixed terminal is brought into engagement with an engaging part of the flange located at the inner part of the case.

In the structure thus constructed, the fixed terminals are stably supported at both the sides thereof, and a sufficient positioning accuracy is secured without taking such a measure that the planting dimension is increased by increasing the thickness of the flange of the spool. Further, at a part near the contact (flange located at the inner part of the case), the fixed terminals are supported by merely engaging, not press-fitting. A chance that cutting dust produced by the press fitting enters the gap between the contacts, and hence contact fault occurs, is remarkably lessened.

In another preferred embodiment, the fixed terminal has the mounting structure as described above, the whole electromagnetic relay is sealed by applying thermosetting sealing material to the opened side of the case, the holes to which the protruded parts are press fit are formed as through holes opened to the case opened side, and the gaps between the through holes and the protruded parts press fit therein are filled with the sealing material.

With such an arrangement, the fixed terminals are secured to the flange located at the case opened side by press-fitting. Bonding action of the sealing material (effective even at high temperature) also contributes to the securing of the fixed terminal to the flange. Accordingly, in the thermal expansion of the coil, the fixed contact (NO contact)(i.e., the top end part of the fixed terminal) is reliably held at a normal position at which it is supported by securing it to the flange located on the opened side of the case (normal position= position sufficiently spaced apart from the movable contact when current is not fed to the coil).

In an additional preferred embodiment of the invention, the fixed terminal has the mounting structure as mentioned above, the engaging part prevents the fixed terminal from moving only in the lateral direction orthogonal to the coil axial direction, and the fixed terminal is movable at least in the coil axial direction at the engaging part.

With such a mechanical arrangement, although the fixed terminals are stably supported as a whole by the respective flanges, there is no chance that the top end part of the fixed terminal (i.e., the fixed contact) is displaced in such a direction that it is pressed against the movable contact, as the result of the deformation of the flange of the spool. Accordingly, occurrence of the conduction retaining, which will cause the fire accident as referred to above, is highly reliably avoided. Additionally, the silencing effect mentioned above is ensured. In this case, an impact produced when the movable contact hits the fixed contact is reliably transmitted to the flange (edge end part) located at the inner part of the case, through the bending (displacement) of the top end part of the fixed terminal with the fixed contact provided thereon. And the edge end part is bent to absorb the impact.

In yet another preferred embodiment, a gap is formed between the top end part (fixed contact) of the fixed terminal and the end edge part of the flange located at the inner part of the case.

With such a mechanical arrangement, it is reliably avoided at the initial stage that the top end part of the fixed terminal (i.e., the fixed contact) is displaced in such a direction that it is pressed against the movable contact, as the result of the deformation of the flange located at the case inner part. The fire or the like is reliably prevented, and the silencing effect is further enhanced. In this case, the impact produced when the movable contact hits the fixed contact is first absorbed by the bending of the top end part of the fixed terminal, as shown in FIGS. 5A and 5B. In turn, the top end part of the fixed terminal comes in contact with the end edge part, and hence the end edge part is bent to further absorb the impact. Thus, the impact is smoothly absorbed in two steps.

According to another aspect of the invention, there is provided a second electromagnetic relay comprising:

a case having an opening at one end thereof and covering the whole electromagnetic relay;

a spool with a coil as an electromagnet wound therearound, the spool including a first flange disposed inside the case and at an opened side of the case, and a second flange disposed at an inner part of the case;

a movable iron member, on which attraction force of the electromagnet acts, disposed at a position closer to the inner part of the case than the spool;

a fixed contact disposed at a top end part of a fixed terminal extending to a position closer to the inner part of the case than the second flange of the spool; and a movable contact, which moves in associated with the movable iron member, disposed at a position closer to the inner part of the case than the fixed contact, the movable contact being brought into contact with or separated from the fixed contact by an attraction force of the electromagnet and a restoring force of a spring for supporting the movable contact, whereby a conduction state between a movable contact terminal conductively coupled to the movable contact and the fixed terminal is switched over, wherein the second flange has at least one protruded part disposed on an surface of the spool facing the inner part of the case, the protruded part coming in contact with the movable iron member to press the movable iron member to the inner side of the case when the spool is thermally expanded in a coil axial direction.

In the second electromagnetic relay, even if the spool is thermally expanded in the coil axial direction, the protruded parts come in contact with the movable iron member to press the movable iron member to the inner side of the case. Accordingly, even if the coil is thermally expanded, the thermally caused force to expand the flange of the spool, which is located at the inner part of the case, is transmitted to the movable iron member. As a result, the movable iron member and the movable contact coupled to the former move to the inner part of the case (move apart from the fixed contact) as the thermal expansion of the spool progresses. Therefore, even if the coil is thermally expanded and the fixed contact slightly displaces to the inner part of the case (toward the movable contact), there is less chance that the fixed contact is pressed against the movable contact and their conduction is retained.

Particularly, when a low strength part, which is low in rigidity and on which stress concentrates, is formed along a portion demarcating the end edge part of a flange located at the inner part of a case, which faces the top end part of a fixed terminal, and the fixed terminal is secured to a flange which is located at the opened side of the case, the synergy effect of the operation of the first electromagnetic relay (the fixed contact does not displace to the inner part of the case even if the coil is thermally expanded) and the operation of the second electromagnetic relay (the movable contact is forcibly displaced in such a direction that it moves apart from the fixed contact when the coil is thermally expanded) remarkably reduces a chance of retaining the contact-to-contact conduction. Accordingly, occurrence of the fire accident as referred to above is highly reliably avoided.

According to a third aspect of the invention, there is provided a third electromagnetic relay comprising:

a case having an opening at one end thereof and covering the whole electromagnetic relay;

a spool with a coil as an electromagnet wound therearound, the spool including a first flange disposed inside the case and at an opened side of the case, and a second flange disposed at an inner part of the case;

a fixed contact disposed at a top end part of a fixed terminal extending to a position closer to the inner part of the case than the second flange of the spool; and a movable contact disposed at a position closer to the inner part of the case than the fixed contact, the movable contact being brought into contact with or separated from the fixed contact by an attraction force of the electromagnet and a restoring force of a spring for supporting the movable contact, whereby a conduction state between a movable terminal conductively coupled to the movable contact and the fixed terminal is switched over, wherein the opening of the case is filled with thermosetting sealing material so that whole electromagnetic relay is sealed, and the fixed terminal is secured to the first flange.

In the third electromagnetic relay, when the flange of the spool outwardly deformed by the coil axial directional pressure displaces in the direction of lessening the spool deformation as the result of the aging after the coil is wound and the heat hardening process of the sealing material, it never happens that the top end part (i.e., the fixed contact) of the fixed terminal, together with the second flange (at the inner part of the case), displaces to the case opened side (apart in space from the movable contact), since the fixed terminal is secured to the first flange (located) on the case opened side. Rather than moving apart from the movable contact, it is pressed against the movable contact by the deformation lessening of the flange at the opened side of the case□(the displacement to the inner part of the case) (viz., the pressure contact increases).

For this reason, the relay of the embodiment succeeds in solving the following problem: The contact pressure, which was adjusted to have an optimum value at the time of assembling the component parts within the case, varies to diminish, thereafter; As a result, it is impossible to secure a required contact pressure, and; The number of the resultant products, which fail to satisfy the required product specifications, is increased (viz., the product yielding decreases). Accordingly, the product yielding is remarkably increased. On the contrary, the contact pressure is increased, and the contact opening/closing performance and the opening/closing lifetime of the contacts are improved.

In the third electromagnetic relay, a specific mounting structure of the fixed terminal is such that a protruded part extending from the fixed terminal is press fit into a hole of the flange at the case opened side, and a part near the fixed contact of the fixed terminal is brought into engagement with an engaging part of the flange at the inner part of the case, as in the first electromagnetic relay. Such a mechanical arrangement accrues to the advantage of eliminating the contact pressure decreasing (or increasing the production yielding). Additionally, as already stated, the fixed terminals are stably supported, so that a sufficient positioning accuracy is secured. Further, a chance that cutting dust produced by the press fitting enters the gap between the contacts and contact fault occurs is remarkably lessened.

Where the mounting structure of fixed terminal is employed, it is preferable that the holes to which the protruded parts are press fit are formed as through holes, and the gaps between the through holes and the protruded parts press fit therein are filled with the sealing material. By so arranged, the fixed terminal is more firmly secured to the flange at the case opened side through the bonding action of the sealing material. The advantageous effects of the invention are more remarkably produced.

Where the mounting structure of fixed terminal is employed, it is preferable that the engaging part prevents the fixed terminal from moving only in the lateral direction orthogonal to the coil axial direction, and the fixed terminal is movable at least in the coil axial direction at the engaging part.

If so arranged, the top end part (or the fixed contact) of the fixed terminal is reliably held at a position at which it is positioned as the result of the support by the flange at the inner part of the case. Accordingly, the problem of the decreasing of the contact pressure is solved reliably (when the deformed flange resumes its original shape, the contact pressure is rather increased than decreased.)

Also, in the third electromagnetic relay, it is preferable that a gap is formed between the top end part of the fixed terminal and the end edge of the second flange.

With the provision of the gap, a deformation of the spool, which is caused when the coil is wound, is absorbed by the gap, and there is no or less chance that the fixed contact is pressed against the movable contact. Further, the problem of the contact pressure decrease caused by the deformation lessening, which follows it, is solved reliably.

DETAILED DESCRIPTION OF THE PREFERRED EMBODIMENTS

The preferred embodiments of the present invention will be described with reference to the accompanying drawings. In the description to be given hereunder, the invention is implemented into small electromagnetic relays (sealing type relays).

An overall construction of an electromagnetic relay constructed according to the invention will be described.

Figure 1A:
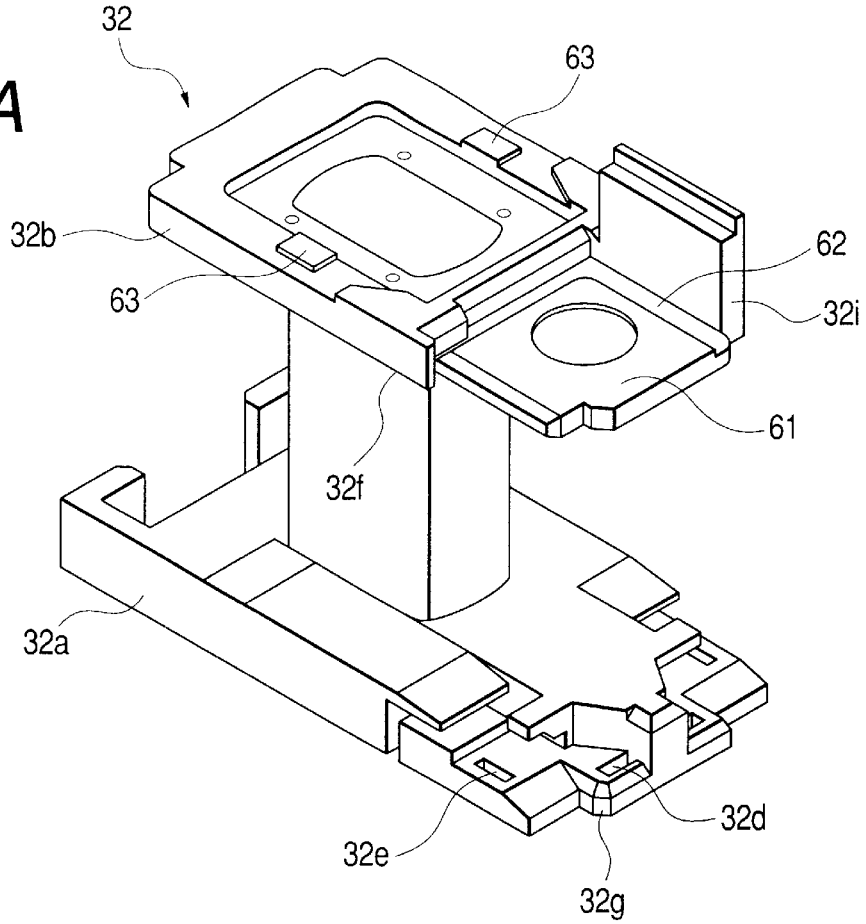
FIGS. 1A and 1B are diagrams showing a spool forming an electromagnetic relay according to the present invention.
Figure 1B:
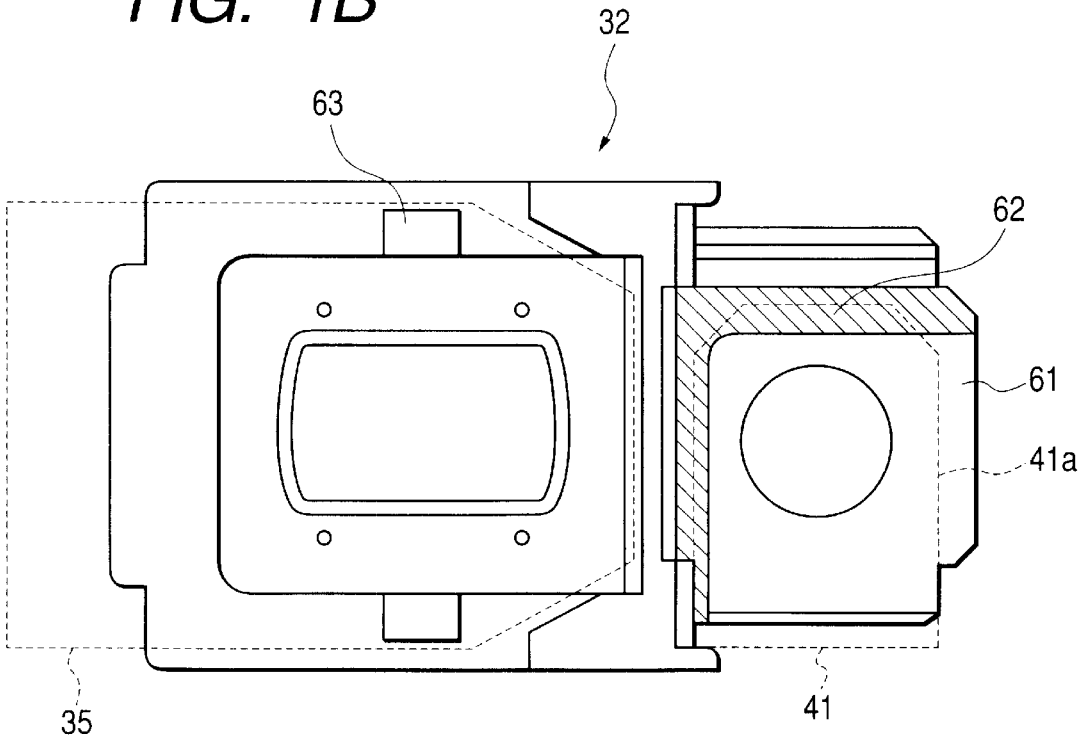
Figure 2A:
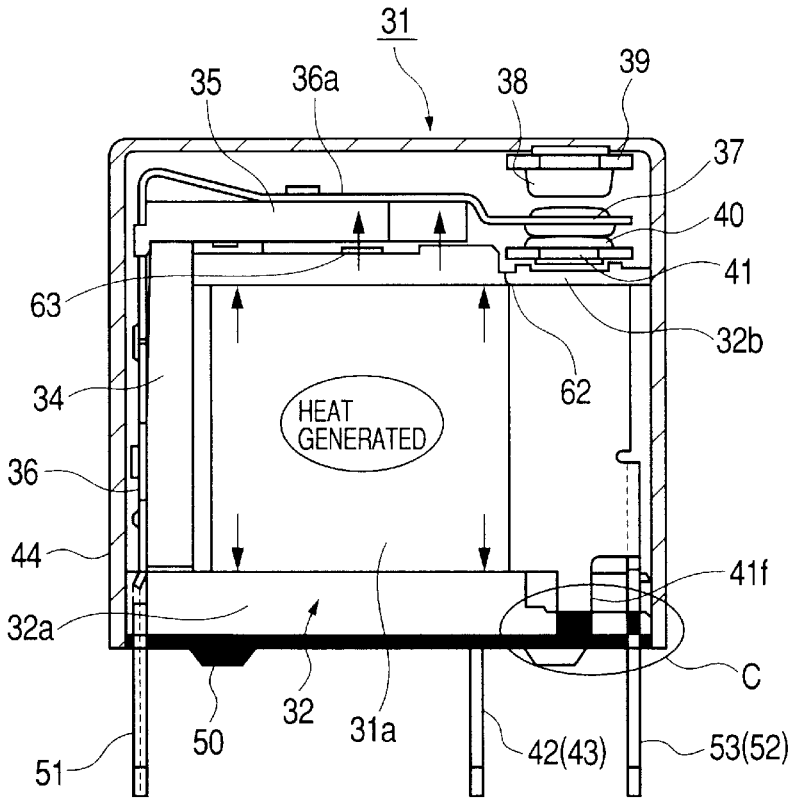
FIGS. 2A and 2B are front views showing an overall structure of the electromagnetic relay and being useful in explaining the operation of the relay.
Figure 2B:
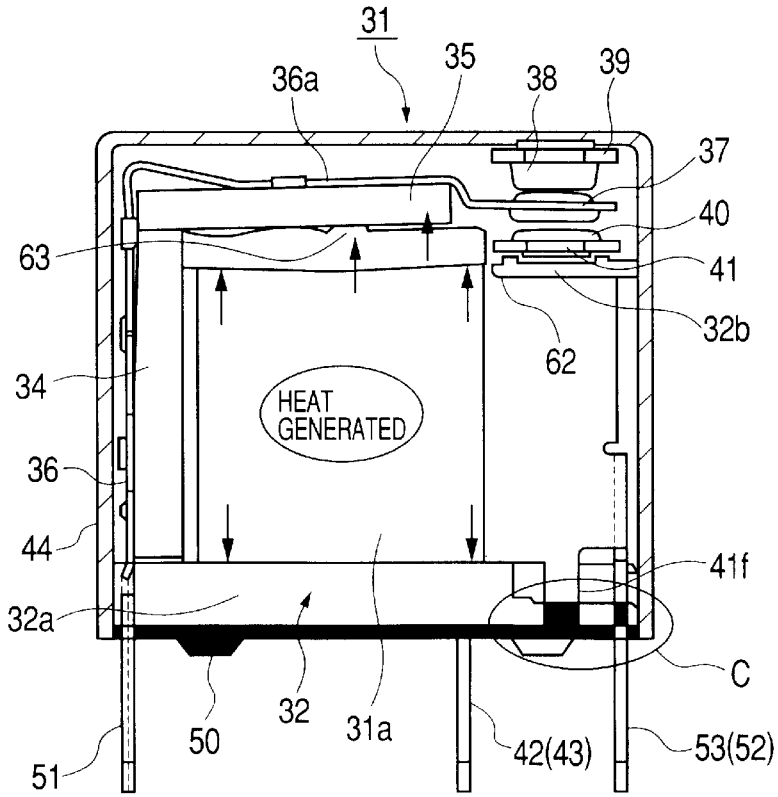
Figure 3:
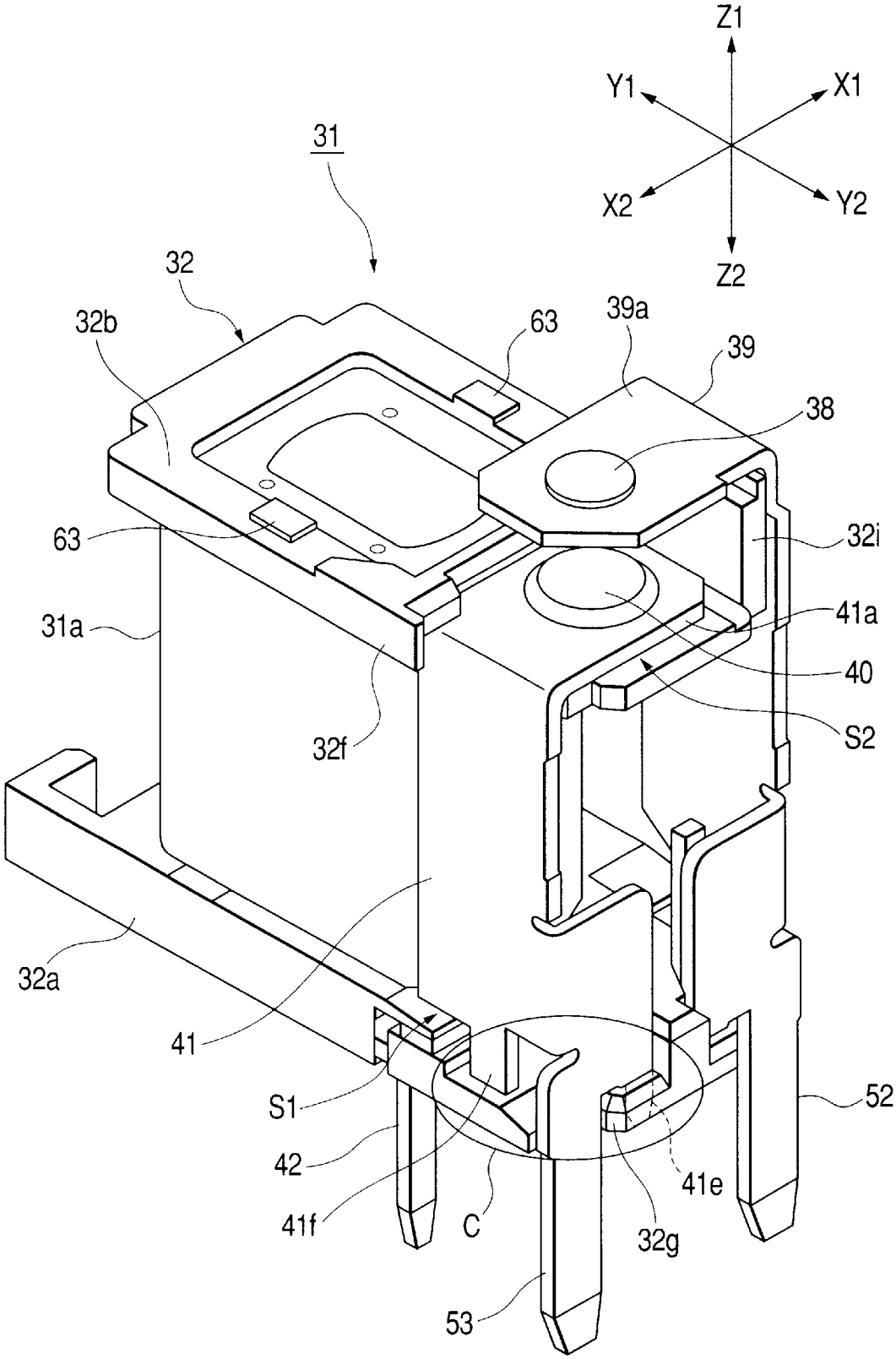
FIG. 3 is a perspective view showing the electromagnetic relay.
Figure 4A:
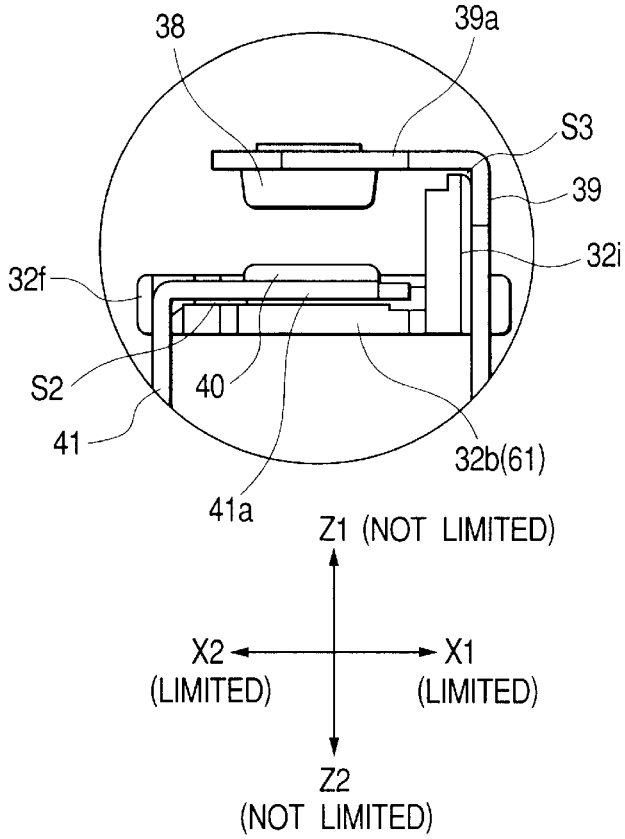
FIGS. 4A and 4B are diagrams showing an engaging part of the fixed terminal.
Figure 4B:
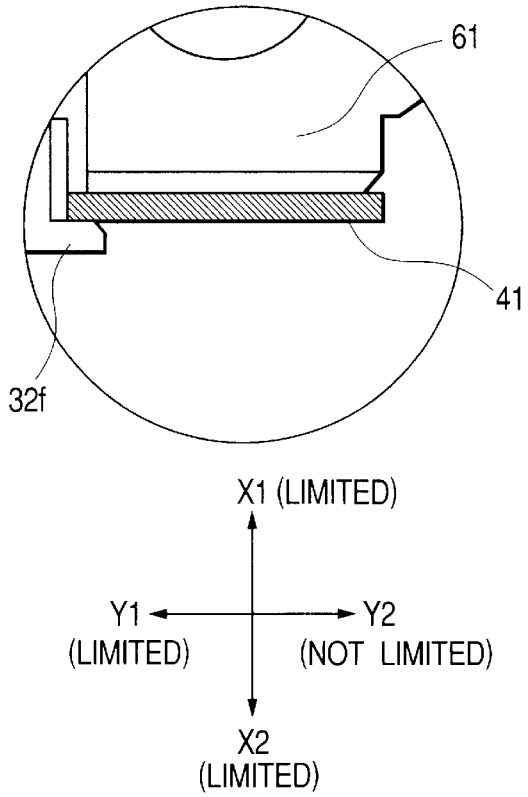

FIG. 1A is a perspective view showing a spool 32 forming an electromagnetic relay 31 of the present invention. FIG. 1B is a top view showing the spool 32. FIGS. 2A and 2B show front views showing the electromagnetic relay 31 (its case and the like of which are removed, and viewed from the front thereof). FIG. 3 is a perspective view showing the electromagnetic relay 31 (of which the case and parts relating to movable contacts are removed). FIG. 4A is a side view showing a top end part (engaging part) of a fixing terminal. FIG. 4B is a top view showing the engaging part of the fixing terminal. In the description to follow, an opened side (lower side in FIGS. 2A and 2B) of a case 44 to be described later will be referred to as a "case opened side", "lower end side", or "lower side". A side of the case, which is opposite to the case opened side, will be referred to as a "case inner side", "upper end side" or "upper side".

As shown in FIGS. 2A, 2B and 3, the electromagnetic relay 31 is constructed with the spool 32, an iron core (not shown) of the electromagnet mounted while being inserted into the spool 32, an L-shaped yoke 34, a movable iron member 35, an L-shaped movable contact spring 36, a movable contact 37, a first fixed contact (NC contact) 38, a first fixed terminal 39, a second fixed contact (NO contact) 40, a second fixed terminal 41, first and second coil terminals 42 and 43, and a case 44. A coil 31*a* forming an electromagnet is wound around the spool 32. The yoke 34 is coupled to the lower end of the iron core 33, and provides a magnetic path allowing lines of magnetic force to pass therethrough. The movable iron member 35 is joined at the base end to the upper end of the yoke 34, and the top end of the movable iron member 35 may be swung under attraction by the iron core when current is fed to the coil. The movable contact spring 36 consists of a plate spring of which the upper part or the plate like part 36*a* may be swung, and the plate like part 36*a* is mounted on the upper surface of the movable iron member 35. The movable contact 37 is mounted to the top end of the movable contact spring 6 by caulking. The movable contact 7 is in pressing contact with the first fixed contact 38 when current is fed to the coil. The first fixed contact 38 is mounted on the upper end of the first fixed terminal 39 by caulking. The movable contact 37 is in pressing contact with the second fixed contact 40 when current is fed to the coil. The second fixed contact 40 is mounted on the upper end of the second fixed terminal 41 by caulking. The first and second coil terminals 42 and 43 are connected to lead wires of the coil 31*a*, respectively. A lower side of the case 44 is opened.

The electromagnetic relay 31 is of the type in which the lower flange 32*a* (first flange) of the spool 32 in FIGS. 1A and 1B serves also as a member called a base. In assembling the relay 31, components parts other than the case 44 are assembled, while using the flange 32*a* as the base member, into a sub-assembly. The case 44 is finally applied to the sub-assembly to cover the latter. Thereafter, the opened side of the case 44 is sealed with a sealing material 50 (shown in FIGS. 2A and 2B) of thermosetting resin (e.g., epoxy resin), to complete an electromagnetic relay. The movable contact spring 36 is mounted on the yoke 34.

The lower parts or strip-like parts of the movable contact spring 36, first fixed terminal 39 and second fixed terminal 41 are protruded at their lower ends to positions lower than the base (the flange 32*a* of the yoke 34), and respectively form connection terminals 51, 52 and 53 used for connecting the individual contacts to given circuit conductors, like the first and second coil terminals 42 and 43. In FIGS. 2A and 2B, the second coil terminal 43 is located on the opposite side of the first coil terminal 42. The lower end of the first fixed terminal 39 (=connection terminal 52) is also located on the opposite side of the lower end of the second fixed terminal 41 (=connection terminal 53).

The spool 32, as shown in FIG. 1A, includes the flange 32*a* located inside the opening of the case 44, and another flange 32*b* (second flange) located on the inner part of the case 44. The flange 32*b* includes an end edge part 61, which faces the lower side (the top end to which the second fixed contact 40 is secured) of a plate-like part 41*a*, which will be described later. A low strength part 62, which is low in rigidity and on which stress concentrates, is formed along an L-shaped part (shaded in FIG. 1B) demarcating the end edge part 61. In this case, the low strength part 62, as shown in FIG. 2A, is a groove formed in the end face of the flange 32*b* at the inner part of the case.

As shown in FIGS. 1A and 1B, two protruded parts 63 are provided respectively at opposite positions on the end surface of the spool 32 located at the inner part of the case. When the spool 32 is thermally expanded in the coil axial direction, the protruded parts 63 come in contact with the movable iron member 35 to press the movable iron member 35 to the inner side of the case.

The spool 32 is a molded piece made of a synthetic resin, e.g., PBT (polybutylene terephthalate). The PBT (polybutylene terephthalate) may be replaced with liquid crystal polymer (LCP).

The first fixed terminal 39 and the second fixed terminal 41, as shown in FIG. 3, are configured such that the top ends of them are bent at right angles into plate-like parts 39*a* and 41*a* with the fixed contacts 38 and 40 secured thereon.

Mounting structures of the first fixed terminal 39 and the second fixed terminal 41 are symmetrical with each other in the present embodiment, as will be described hereunder.

The mounting structure of the second fixed terminal 41 will typically be described. As shown in FIG. 3, the second fixed terminal 41 is provided with protruded parts 41*e* and 41*f*, which extend to the terminal side. through-holes 32*d* and 32*e* (see FIG. 1A) into which the protruded parts 41*e* and 41*f* may be press fit are formed in the flange 32*a* of the spool 2 located on the case opened side.

The flange 32*b* of the spool 32 (located on the inner part of the case) includes an engaging part 32*f*, shaped like L (or hook), which will be brought into engagement with the side edge of the plate-like part of the second fixed terminal 41, which extends in the coil axial direction. When the engaging part engages with the side edge; the lateral movements of the second fixed terminal 41 at a part near the contact are prevented in the directions X1, X2, Y1 in FIG. 3 (see FIG. 4B).

As shown in FIG. 1A or 3, a fitting part 32*g*, which will be fit into an elongated depression (not designated by reference numeral) between the protruded part 41*e* and the connection terminal 53, is formed at a part of the flange 32*a* adjacent to the through-hole 32*d*. In the mounting state of the fixed terminal 41, this fitting part 32*g* is fit to the elongated depression, tightly. The fixed terminal 41 is prevented from being moved in the fitting direction (to the case opened side) at this portion.

A height of a portion near the through-hole 32*e* of the flange 32*a* is selected such that in the mounting state of the fixed terminal 41, it does not contact with the fixed terminal 41 (except the protruded part 41*f*). Accordingly, a minute gap S1 (shown in FIG. 3) is formed between the portion near the through-hole of the flange 32*a* and the fixed terminal 41 (except the protruded part 41*f*).

Specifically, the dimensions of the related parts are selected such that when the fixed terminal 41 is moved straightly in the longitudinal direction while being kept parallel to the coil axial direction, and the protruded parts 41*e* and 41*f* are press-fit into the through-holes 32*d* and 32*e*, respectively, the fitting part 32*g* is first fit into the depression, and at this time, the minute gap S1 is secured.

The length dimension of the fixed terminal 41 (as viewed in the coil axial direction) is selected such that in the mounting state of the fixed terminal 41, a minute gap S2 (FIG. 4A) is formed also between the plate-like part 41*a* of the fixed terminal 41 (or the fixed contact 40) and the flange 32*b*.

In this case, the fixed terminal 41 is assembled in a simple manner as given below.

The fixed terminal 41 is moved straightly in the longitudinal direction while being kept parallel to the coil axial direction. Then, the fixed terminal 41 is pressed down while the side edge of the fixed terminal 41 is put in engagement with the engaging part 32*f* of the flange 32*b*, to press fit the protruded parts 41*e* and 41*f* of the fixed terminal 41 into the through-holes 32*d* and 32*e* of the spool 32.

In this case, the movement of the fixed terminal 41 in the longitudinal direction is stopped as a whole at an instant that the engaging part 32*f* is fit into the groove (the movement of the protruded part 41*e* in the press fitting direction is stopped). At this time, however, the movement of the protruded part 41*f* to the press fitting direction is not interrupted since the minute gap S1 is secured in the assembled state. Accordingly, the fixed terminal 41 is allowed to turn with the fulcrum of the protruded part 41*e* or the fitting part 32*g* in a direction; in this case, the direction Y1 in FIG. 4B in this case. For this reason, when a position of the fixed terminal 41, which is located on the inner side of protruded part 41*e* (as viewed in the lateral direction), is pressed to the inner side by a predetermined pressure, its turn is blocked by the engaging part 32*f*, while taking a predetermined assembling attitude (in this case, standing upright in the coil axial direction). However, a torque is generated which has the turning direction and is proportional in amplitude to a pressing force. This torque is left as a moment of force (i.e., torque) to slightly elastically deform the flange 32*b* and the like after the pressing force for the assembling work (press fitting work) is removed since the fixed terminal 41 is pulled to the turning direction by a friction force (or a securing force by the sealing material 50) by press fitting the protruded part 41*f* into the through-hole 32*e*.

In the mounting structure as mentioned above, the fixed terminal 41 is supported at three points, the two pressing parts and the engaging part 32*f*. Further, in this mounting structure, it is constantly pressed in the direction Y1 (to prevent it from falling off the engaging part 32*f*) in FIG. 4B, by the residual torque. A balance is set up between this residual torque and the counter force of the engaging part 32*f*, and as a result, it is standstill.

While the mounting structure of the fixed terminal 41 and the way of mounting the same have been described, the same thing is correspondingly applied to the mounting structure of the first fixed terminal 39 and the like (its detail description and illustration using reference numerals and symbols are omitted.). A gap S3 (shown in FIG. 4A), like the minute gap S2, is provided, in design, also between a longitudinal plate-like part 32*i* of the flange 32*b*, which is located on the inner side of the plate-like part 39*a* of the first fixed terminal 39, and the plate-like part 39*a*.

The through-holes 32*d* and 32*e* are opened also at the case opened side of the flange 32*a*. Accordingly, the sealing material 50 enters also the through-holes 32*d* and 32*e* by a capillary phenomenon and gravity. A portion into which the sealing material 50 flows, which is painted black in FIGS. 2A and 2B, is formed in the portion (denoted as C in FIGS. 2A and 2B) to which the fixed terminal 41 is press fit. Such a flow-in portion is formed also in a portion to which the first fixed terminal 39 is press fit.

The sealing material 50 is applied to the relay in the following manner. The electromagnetic relay 31 after assembled is put in a state that the opened side of the case is directed upward. In this state, a given amount of sealing material 50 (not hardened) is dropped or poured into the case opened side. Then, the sealing material 50 enters the respective gaps in the opened side of the case by natural flowing caused by the gravity and capillary phenomenon. As a result, a sealing layer the surface of which is flat is formed within the opening of the case. Thereafter, the whole electromagnetic relay 31 is put in a hardening bath. In the bath, the sealing material 50 is heated at a hardening temperature of the sealing material 50 or higher for a predetermined time, whereby the sealing material 50 is hardened.

When the coil 31*a* of the electromagnetic relay 31 thus constructed is thermally expanded, a force acts on the flange 32*b* (located at the inner part of the case) of the spool 32 to expand the flange 32*b*. In this case, a transmission of such a force is blocked or impeded in the low strength part 62. Meanwhile, the fixed terminal 41 (=fixed terminal for NO contact) is secured to the flange 32*a* (located at the opened side of the case) of the spool. Therefore, even if the coil 31*a* is thermally expanded, the end edge part 61 of the flange 32*b*, which faces the top end part (plate-like part 41*a*) of the fixed terminal 41, and the fixed contact 40 (NO contact) are not displaced to the inner side of the case (toward the movable contact 37) (or its displacement is considerably reduced or it is displaced to the opened side of the case). For this reason, such an unwanted situation that the coil 31*a* is thermally expanded, the spool 32 is deformed, and hence he fixed contact 40 is pressed against the movable contact 37, never happens. Accordingly, even in an abnormal state of overcurrent feeding, there is no chance that that the fixed contact 40 is held while being in contact with the movable contact 37 (viz., the relay has a function of self-interrupting the overcurrent.). In other words, even when the coil is heated to excessive temperature, the fixed contact 40 can be separated from the movable contact 37 to the opened side of the case. Accordingly, a probability that fire accident occurs owing to the conduction retaining is completely eliminated.

In particular, when the low strength part 62 is designed such that it is broken by stress and heat caused by an abnormal expansion of the coil as shown in FIG. 2B, the transmission of the force acting to pressing the fixed contact 40 against the movable contact 37 (viz., the force for displacing it toward the inner part of the case) is completely blocked. The fixed contact 40 is reliably held at a normal position at which it is supported by the fixed terminal 41 secured to the flange 32*a* located on the opened side of the case (normal position=position sufficiently spaced apart from the movable contact when current is not fed to the coil). Accordingly, fire accident can be prevented with higher reliability.

Further, a plurality of protruded parts 63 are provided on the end surface of the spool 32, which is located at the inner part of the case. Even if the spool 32 is thermally expanded in the coil axial direction, the protruded parts 63 come in contact with the movable iron member 35 to press the movable iron member 35 to the inner side of the case. Accordingly, even if the coil is thermally expanded, the thermally caused force to expand the flange 32*b* of the spool 32, which is located at the inner part of the case, is transmitted to the movable iron member 35. As a result, the movable iron member 35 and the movable contact 37 coupled to the former move to the inner part of the case (move apart from the fixed contact 40) as the thermal expansion of the spool 32 progresses. Therefore, even if the coil is thermally expanded and the fixed contact 40 slightly displaces to the inner part of the case (toward the movable contact 37), there is less chance that the fixed contact 40 is pressed against the movable contact 37 and their conduction is retained.

In the present invention, the synergy effect of the operation of the first electromagnetic relay (the fixed contact does not displace to the inner part of the case even if the coil is thermally expanded) and the operation of the second electromagnetic relay (the movable contact is forcibly displaced in such a direction that it moves apart from the fixed contact when the coil is thermally expanded) remarkably reduces a chance of retaining the contact-to-contact conduction. Accordingly, occurrence of the fire accident as referred to above is highly reliably avoided.

The flange 32*a* of the case opened side is used lubricant also as a base for the assembling of the relay. Accordingly, it is designed to be thick and having a high rigidity when comparing with the flange 32*b* of the inner part of the case. Accordingly, where the fixed terminal 41 is secured to the flange 32*a* of the case opened side, the top end part (i.e., the fixed contact 40) of the fixed terminal 41 is hard to displace toward the movable contact. The fixed contact 40 is reliably held at a position separated from the movable contact 37 while not affected by the deformation of the flange 32*b* of the case inner part since the low strength part 62 is present.

The electromagnetic relay 31 constructed as described above succeeds in solving the problem of the deformation of the spool 32 by the pressure having the coil axial direction and the configuration recovery of the deformed spool which subsequently occurs.

Figure 6A:
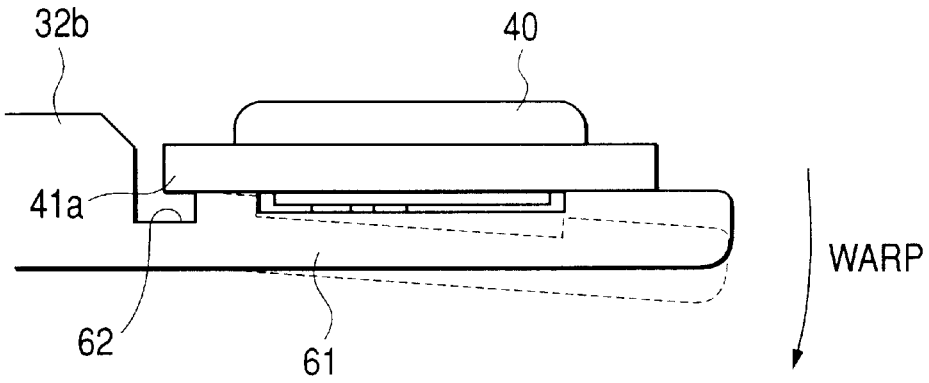
FIGS. 6A and 6B are diagrams for explaining the eliminating or lessening operation of a displacement of the fixed contact.
Figure 6B:
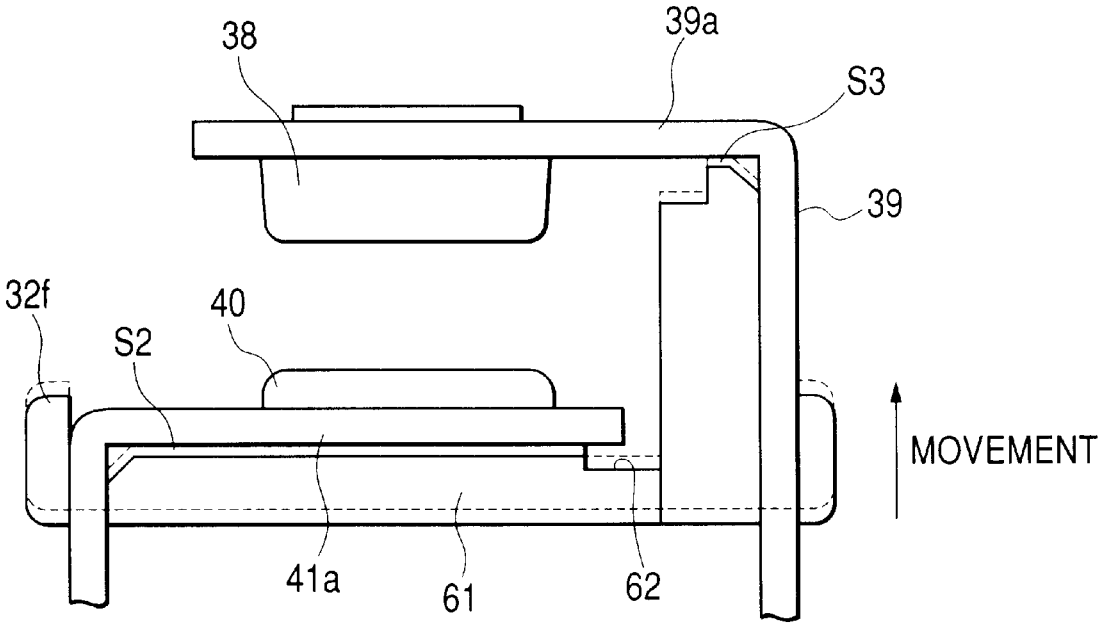

The reason for this follows. When the spool 32 is deformed to be expanded by the pressure having the coil axial direction as shown FIG. 6A, the end edge part 61 facing the top end part of the fixed terminal 41 (i.e., the plate-like part 41*a* secured to the fixed contact 40) is greatly bent since the low strength part (groove) 62 is present. With the bending, a force applied to the top end part of the fixed terminal 41 is greatly lessened. As a result, there is no or little chance that the spool 32 is deformed by the coil axial directional pressure, and hence the fixed contact 40 is pressed against the movable contact 37. Thence, the contact pressure reduction arising from the subsequent configuration recovery of the deformed spool is removed or lessened.

Further, it is noted that the fixed terminal 41 is secured to the flange 32*a* located at the opened side o the case. This technical feature brings about the following advantage. When the flange 32*b* of the spool 32 outwardly deformed by the coil axial directional pressure displaces in the reverse direction, or in the direction of lessening the spool deformation as the result of the aging after the coil is wound and the heat hardening process of the sealing material 50, it never happens that the top end part of the fixed terminal 41 (i.e., the fixed contact 40), together with the flange 32*b* located at the inner part of the case, displaces to the case opened side (apart in space from the movable contact 37), since the fixed terminal 41 is secured to the flange 32*a* on the case opened side. Rather than moving apart from the movable contact, it is pressed against the movable contact 37 by the deformation lessening of the flange 32*a* at the opened side of the case□(the displacement to the inner part of the case) (viz., the pressure contact increases).

For this reason, the relay of the embodiment succeeds in solving the following problem: The contact pressure, which was adjusted to have an optimum value at the time of assembling the component parts within the case, varies to diminish, thereafter; As a result, it is impossible to secure a required contact pressure, and; The number of the resultant products, which fail to satisfy the required product specifications, is increased (viz., the product yielding decreases). Accordingly, the product yielding is remarkably increased. On the contrary, the contact pressure is increased, and the contact opening/closing performance and the opening/closing lifetime of the contacts are improved.

The electromagnetic relay 31 of the embodiment is capable of suppressing the vibration and noise generated when the contact is closed (produces silencing effects). The reason for this is that the vibration caused when the movable contact 37 hits the fixed contact 40 is flexibly absorbed by the end edge part 61 of the flange 32*b* at the case inner part, which is disposed facing the plate-like part 41*a* with the fixed contact 40. More specifically, the end edge part 61 is delineated by the low strength part 62 or parted from the remaining portion by the same. Accordingly, it is easy to be bent. The vibration is absorbed by its flexible deformation. As a result, the noise caused by the vibration is reduced.

Additionally, it is noted that the low strength part 62 takes the form of the groove. This groove serves also as a barrier to prevent insulation deterioration by carbon particles generated when the contact is opened and closed.

In the instant embodiment, the fixed terminals are secured to the flange 32*a* in a manner that the protruded parts of the first and fixed terminals 39 and 41 are press fit to the holes of the flange 32*a* located at the case opened side, and a part near the fixed terminal of the fixed terminals is brought into engagement with the flange 32*b* located on the inner part of the case.

Accordingly, the fixed terminals are stably supported at both the sides thereof, and a sufficient positioning accuracy is secured without taking such a measure that the planting dimension is increased by increasing the thickness of the flange 32*a* of the spool 32. Further, at a part near the contact (flange 32*b* located at the inner part of the case), the fixed terminals are supported by merely engaging, not press-fitting. A chance that cutting dust produced by the press fitting enters the gap between the contacts and contact fault occurs is remarkably lessened.

The embodiment employs the mounting structures of the fixed terminals. The whole relay is sealed by applying the thermosetting sealing material 50 to the opened side of the case 44. The holes to which the protruded parts are press fit are formed as through holes. The gaps between the through holes and the protruded parts press fit therein are filled with the sealing material.

Accordingly, the fixed terminals are secured to the flange 32*a* located at the case opened side by press-fitting. Bonding action of the sealing material 50 (effective even at high temperature) also contributes to the securing of the fixed terminal to the flange 32*a*. The fixed contact is reliably held at a normal position at which it is supported by securing it to the flange 32*a* located on the opened side of the case (normal position=position sufficiently spaced apart from the movable contact when current is not fed to the coil).

The embodiment employs the mounting structures of the fixed terminals as stated above. Their engaging parts prevent the fixed terminals from moving only in the lateral direction orthogonal to the coil axial direction. Accordingly, the fixed terminals are movable at least in the coil axial direction at the engaging part.

For this reason, while the fixed terminals are stably supported as a whole by the respective flanges, there is no chance that the top end part of the fixed terminal 41 (i.e., the fixed contact 40) is displaced in such a direction that it is pressed against the movable contact 37, as the result of the deformation of the flange 32*b* of the spool 32. Accordingly, occurrence of the conduction retaining, which will cause the fire accident as referred to above, is highly reliably avoided. Additionally, the silencing effect mentioned above is ensured. In this case, an impact produced when the movable contact 37 hits the fixed contact 40 is reliably transmitted to the flange 32*b* (end edge part 61) located at the inner part of the case, through the bending (displacement) of the fixed terminal plate-like part 41*a* with the fixed contact 40 provided thereon. And the end edge part 61 is bent to absorb the impact.

Figure 5A:
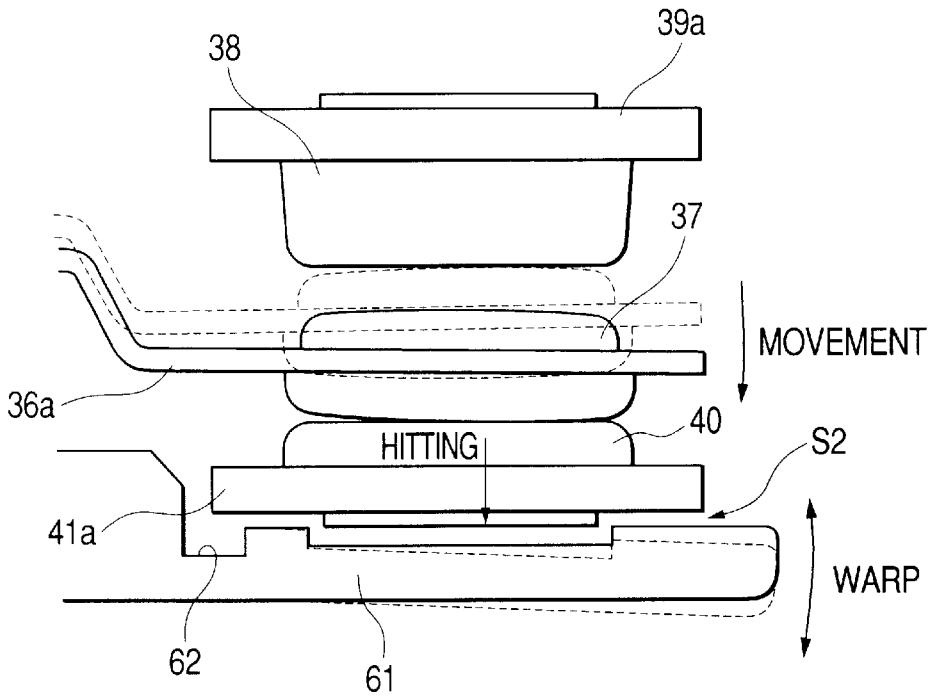
FIGS. 5A and 5B are diagrams for explaining a silencing operation of the relay.
Figure 5B:
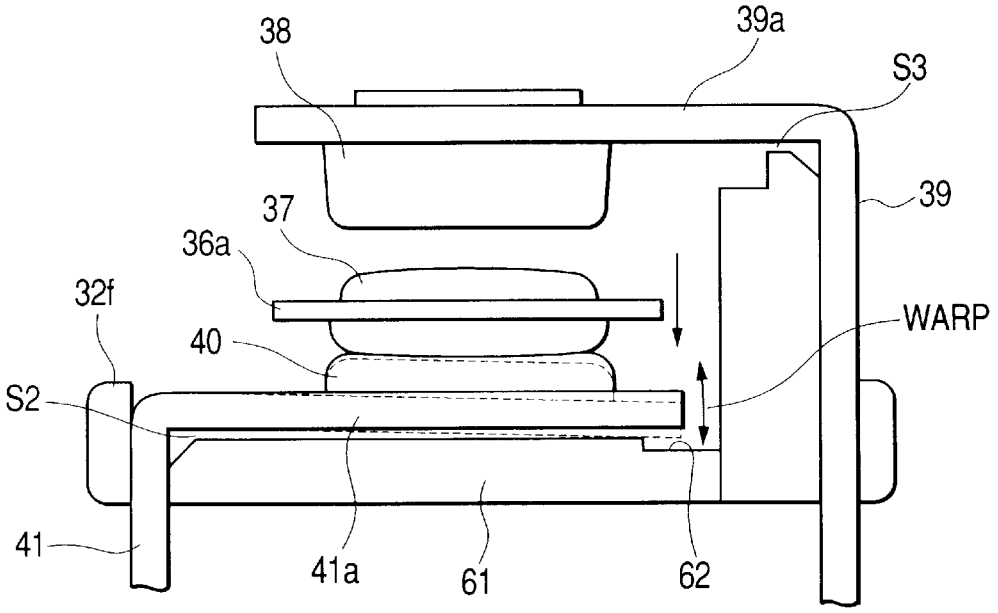

Additionally, in the embodiment, the minute gap S2 is formed between the plate-like part 41*a* (fixed contact 40) of the fixed terminal 41 and the end edge part 61 facing the former. With the provision of the gap, it is reliably avoided at the initial stage that the top end part 41*a* of the fixed terminal 41 (i.e., the fixed contact 40) is displaced in such a direction that it is pressed against the movable contact 37, as the result of the deformation of the flange 32*b* located at the case inner part. The fire or the like is reliably prevented, and the silencing effect is further enhanced. In this case, the impact produced when the movable contact 37 hits the fixed contact 40 is first absorbed by the bending of the plate-like part 41*a* of the fixed terminal 41, as shown in FIGS. 5A and 5B. In turn, the plate-like part 41*a* of the fixed terminal 41 comes in contact with the end edge part 61, and it is bent to further absorb the impact. Thus, the impact is smoothly absorbed in two steps.

It should be understood that the invention is not limited to the above-mentioned embodiment, but may variously be modified, altered and changed within the true spirits of the invention.

Figure 7A:
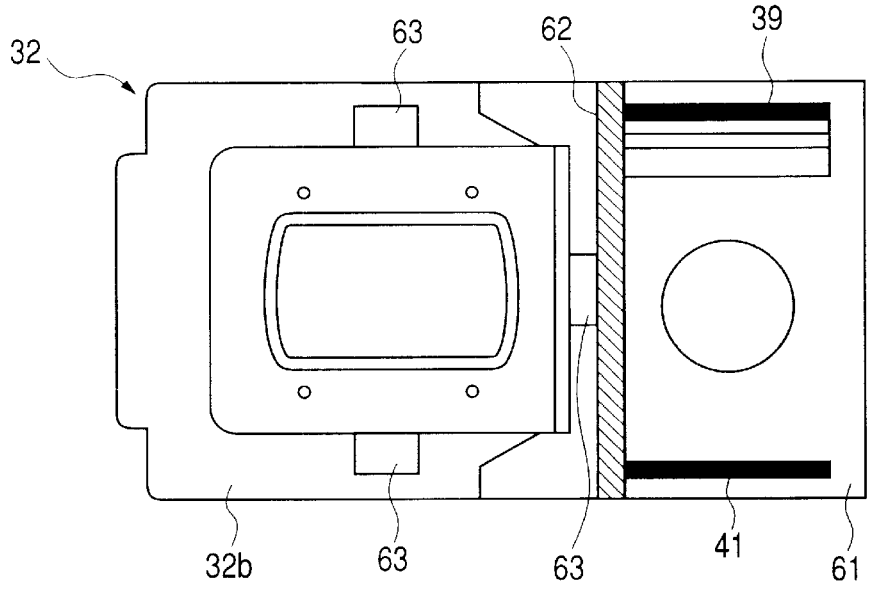
FIGS. 7A and 7B are diagrams showing another electromagnetic relay.
Figure 7B:
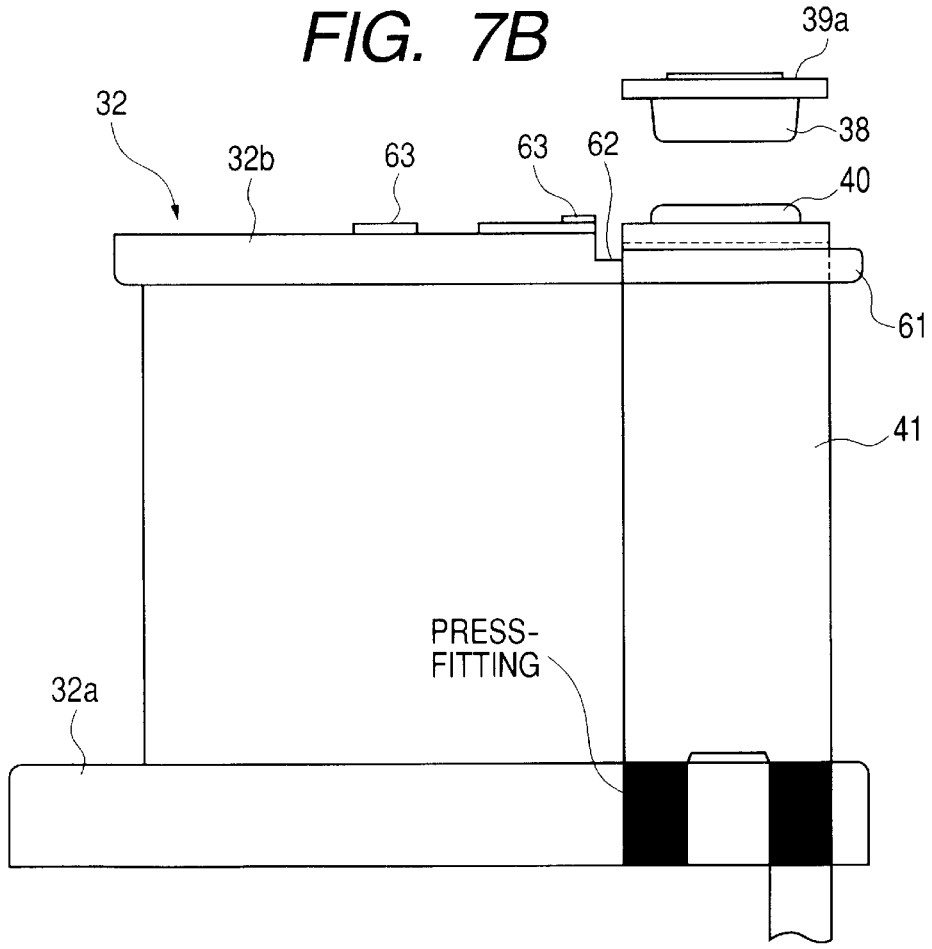
Figure 8A:
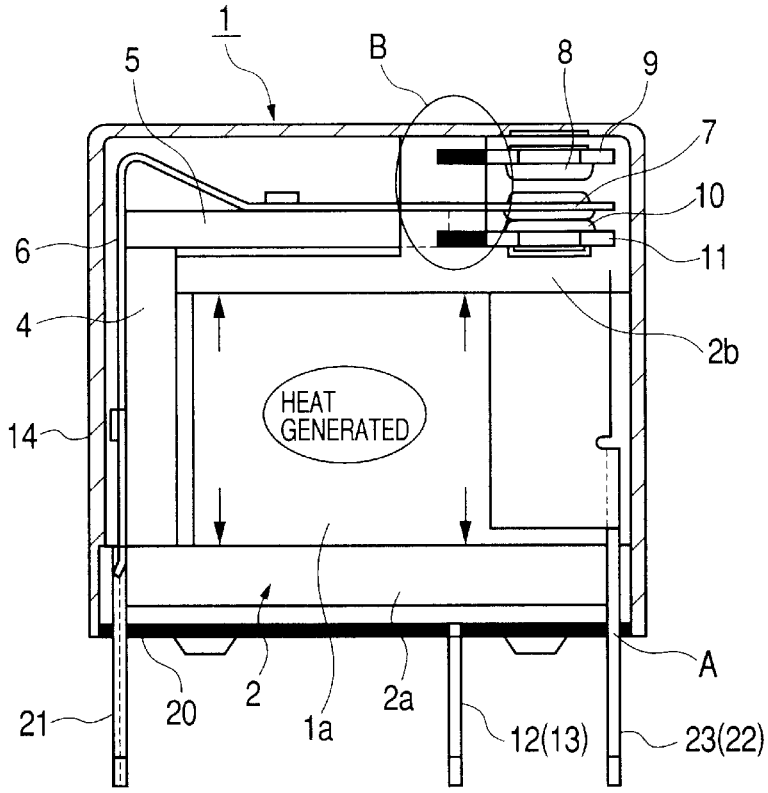
FIGS. 8A and 8B are diagrams for explaining a problem (contact-on failure) of a conventional electromagnetic relay.
Figure 8B:
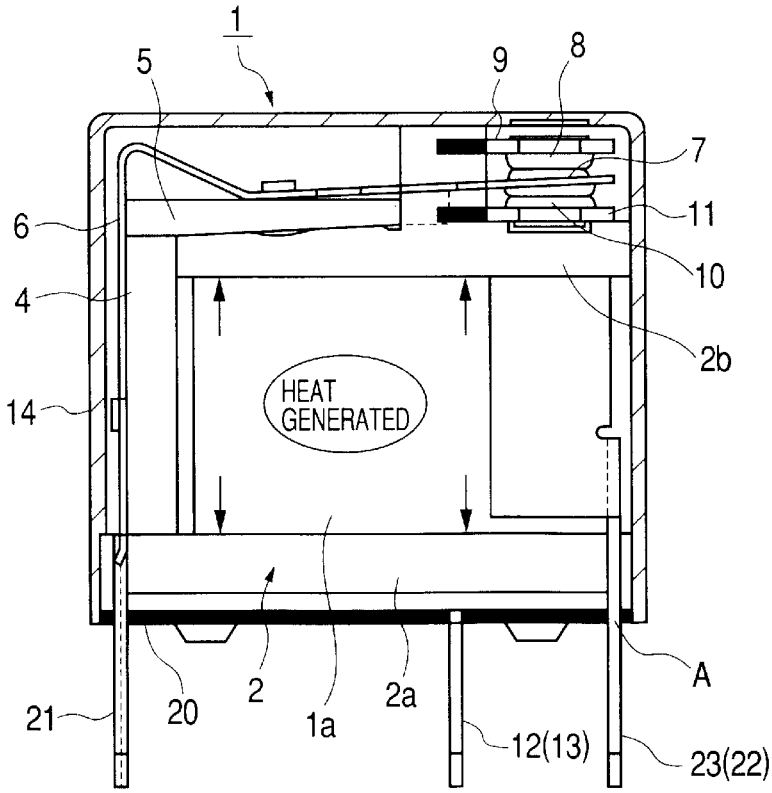
Figure 9A:
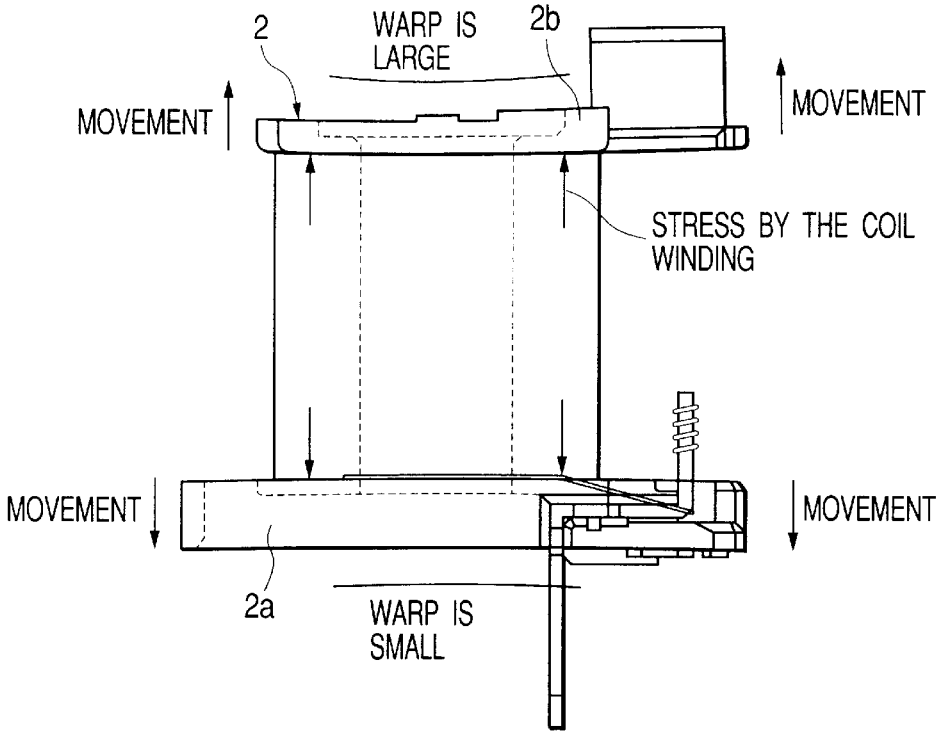
FIGS. 9A and 9B are diagrams for explaining another problem (contact pressure variation by spool deformation) of the conventional electromagnetic relay.
Figure 9B:
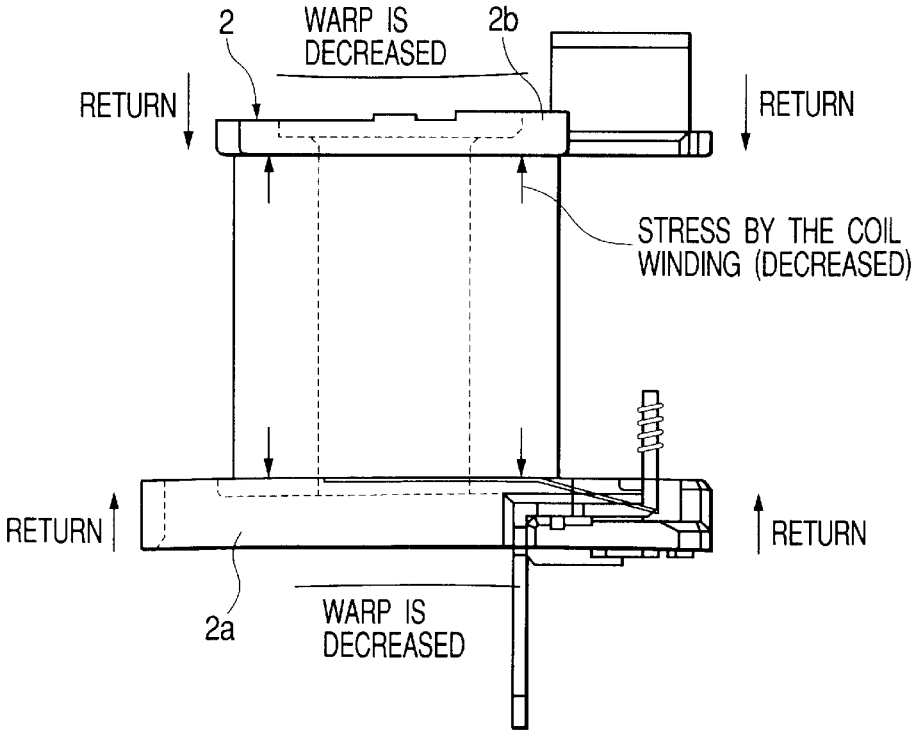

In a modification, as shown in FIGS. 7A and 7B, the low strength part (groove) 62 is linearly formed, and a plurality of protruded parts 63 are additionally provided.

The low strength part may be realized with a plurality of holes formed in the flange located at the inner part of the case (the holes may take the form of through holes or holes other than the through holes).

It is no essential to mechanically arrange the mounting structure of the fixed terminal so as to generate the residual torque. The adverse effect by the lateral displacement of the contact is not serious, as mentioned above. Accordingly, if it is within the tolerable range, use of one press-fitting part for the fixed terminal at the case opened side suffices.

If required, the press-fitting parts at the case opened side and the engaging part at the inner part of the case (a part near the fixed contact) may be increased in number.

The fixed terminal is not always mounted while being moved linearly and parallel. The electromagnetic relay may be assembled not only by use of an automatic assembling machine but also by manual. Where it may be mounted while being moved linearly and parallel, the automatic assembling is easy and hence, the production efficiency is improved.

Also, in the structure as of the embodiment mentioned above, there is no need of presence of the gaps S1, S2 and S3 in a state that the actual assembling is completed. The dimensional values of the gaps S1, S2 and S3 presented in the embodiment mentioned above are the design values which are selected not allowing for member deformations (elastic deformation and plastic deformation). Actually, deformation of the flanges of the spool is absorbed at the gaps S1, S2 and S3, and those gaps are frequently zero in dimensional values.

While the electromagnetic relay used in the embodiment is of the C contact type (using both the NC contact and NO contact), the invention may be applied to a type of electromagnetic relay which contains only the NO contact, as a matter of course.

In the first electromagnetic relay constructed according to the invention, if the coil is thermally expanded, a transmission of such a force as to act on a second flange (located at the inner part of the case) of the spool to expand the second flange is blocked or impeded in the low strength part. Meanwhile, the fixed terminal (=fixed terminal for NO contact) is secured to a first flange (located at the opened side of the case) of the spool. Therefore, even if the coil is thermally expanded, the end edge part of the flange located at the inner part of the case, which faces the top end part (fixed contact) of the fixed terminal, and the fixed contact are not displaced to the inner side of the case (toward the movable contact) (or its displacement is considerably reduced or it is displaced to the opened side of the case). For this reason, such an unwanted situation that the coil is thermally expanded, the spool is deformed, and hence the fixed contact (NO contact) is pressed against the movable contact, never happens. Accordingly, even in an abnormal state of overcurrent feeding, there is no chance that that the fixed contact (NO contact) is held while being in contact with the movable contact (viz., the relay has a function of self-interrupting the overcurrent.). In other words, even when the coil is heated to excessive temperature, the fixed contact (NO contact) can be separated from the movable contact to the opened side of the case. Accordingly, a probability that fire accident occurs owing to the conduction retaining is completely eliminated.

In the second electromagnetic relay constructed according to the invention, even if the coil is thermally expanded, the thermally caused force to expand the flange of the spool, which is located at the inner part of the case, is transmitted to the movable iron member. As a result, the movable iron member and the movable contact coupled to the former move to the inner part of the case (move apart from the fixed contact) as the thermal expansion of the spool progresses. Therefore, even if the coil is thermally expanded and the fixed contact slightly displaces to the inner part of the case (toward the movable contact), there is less chance that the fixed contact (NO contact) is pressed against the movable contact and their conduction is retained.

Particularly, when a low strength part is formed along a portion demarcating the end edge part of a flange located at the inner part of a case, which faces the top end part of a fixed terminal, and the fixed terminal is secured to a flange which is located at the opened side of the case (this second invention is combined with the first invention), the synergy effect of the operation of the first invention (the fixed contact does not displace to the inner part of the case even if the coil is thermally expanded) and the operation of the second invention (the movable contact is forcibly displaced in such a direction that it moves apart from the fixed contact when the coil is thermally expanded) remarkably reduces a chance of retaining the contact-to-contact conduction. Accordingly, occurrence of the fire accident as referred to above is highly reliably avoided.

In the third electromagnetic relay constructed according to the invention, when the flange of the spool outwardly deformed by the coil axial directional pressure displaces in the reverse direction, or in the direction of lessening the spool deformation as the result of the aging after the coil is wound and the heat hardening process of the sealing material, it never happens that the top end part (i.e., the fixed contact) of the fixed terminal, together with the second flange (at the inner part of the case), displaces to the case opened side (apart in space from the movable contact), since the fixed terminal is secured to the first flange (located) on the case opened side. Rather than moving apart from the movable contact, it is pressed against the movable contact by the deformation lessening of the flange at the opened side of the case□(the displacement to the inner part of the case) (viz., the pressure contact increases).

For this reason, the relay of the embodiment succeeds in solving the following problem: The contact pressure, which was adjusted to have an optimum value at the time of assembling the component parts within the case, varies to diminish, thereafter. As a result, it is impossible to secure a required contact pressure. The number of the resultant products, which fail to satisfy the required product specifications, is increased (viz., the product yielding decreases). Accordingly, the product yielding is remarkably increased. On the contrary, the contact pressure is increased, and the contact opening/closing performance and the opening/closing lifetime of the contacts are improved.

What is claimed is:

1. An electromagnetic relay comprising:

a case having an opening at one end thereof and covering said whole electromagnetic relay;

a spool with a coil as an electromagnet wound therearound, said spool including a first flange disposed inside said case and at an opened side of said case, and a second flange disposed at an inner part of said case;

a fixed contact disposed at a top end part of a fixed terminal extending to a position closer to the inner part of said case than said second flange of said spool; and a movable contact disposed at a position closer to the inner part of said case than said fixed contact, the movable contact being brought into contact with or separated from said fixed contact by an attraction force of the electromagnet and a restoring force of a spring for supporting said movable contact, whereby a conduction state between a movable terminal conductively coupled to said movable contact and said fixed terminal is switched over, wherein said second flange has an end edge part facing the top end part of said fixed terminal, and a low strength part, which is low in rigidity and on which stress concentrates, disposed along a portion demarcating the end edge part of said second flange, and said fixed terminal is secured to said first flange.

2. The electromagnetic relay according to claim 1, wherein said low strength part is a groove formed on a surface of said second flange facing the inner part of said case.

3. The electromagnetic relay according to claim 1, wherein said low strength part includes a plurality of holes formed in said second flange.

4. The electromagnetic relay according to claim 1, wherein said fixed terminal has a protruded part extending from the top end part thereof to the opened side of said case, said first flange has a hole, and said second flange has an engaging part, wherein said fixed terminal is secured to said first flange in a manner that the protruded part of said fixed terminal is press fit into the hole of said first flange, and a part near said fixed contact of said fixed terminal is brought into engagement with the engaging part of said second flange.

5. The electromagnetic relay according to claim 4, wherein the opening of said case is filled with thermosetting sealing material so that said electromagnetic relay is sealed, and the hole of said first flange is a through hole wherein a gap between said through hole and said protruded part press fit therein is filled with said sealing material.

6. The electromagnetic relay according to claim 4, wherein said engaging part of said second flange prevents said fixed terminal from moving only in a lateral direction orthogonal to a coil axial direction, and said fixed terminal is movable at least in the coil axial direction at said engaging part.

7. The electromagnetic relay according to claim 1, wherein a gap is formed between the top end part of said fixed terminal and an end edge of said second flange facing the top end part of said fixed terminal.

8. An electromagnetic relay comprising:

a case having an opening at one end thereof and covering said whole electromagnetic relay;

a spool with a coil as an electromagnet wound therearound, said spool including a first flange disposed inside said case and at an opened side of said case, and a second flange disposed at an inner part of said case;

a movable iron member, on which attraction force of the electromagnet acts, disposed at a position closer to the inner part of said case than said spool;

a fixed contact disposed at a top end part of a fixed terminal extending to a position closer to the inner part of said case than said second flange of said spool; and a movable contact, which moves in associated with said movable iron member, disposed at a position closer to the inner part of said case than said fixed contact, the movable contact being brought into contact with or separated from said fixed contact by an attraction force of the electromagnet and a restoring force of a spring for supporting said movable contact, whereby a conduction state between a movable contact terminal conductively coupled to said movable contact and said fixed terminal is switched over, wherein said second flange has at least one protruded part disposed on an surface of said spool facing the inner part of said case, said protruded part coming in contact with said movable iron member to press said movable iron member to the inner side of said case when said spool is thermally expanded in a coil axial direction.

9. The electromagnetic relay according to claim 8, wherein said second flange has a low strength part, which is low in rigidity and on which stress concentrates, disposed along a portion demarcating an end edge part of said second flange facing the top end part of said fixed terminal, and said fixed terminal is secured to said first flange.

10. The electromagnetic relay according to claim 4, wherein a gap is formed between a portion adjacent the hole of the first flange and the fixed terminal.

* * * * *